US011840909B2

(12) United States Patent
Potapenko et al.

(10) Patent No.: US 11,840,909 B2
(45) Date of Patent: Dec. 12, 2023

(54) ATTAINING ACCESS TO COMPROMISED FRACTURED PRODUCTION REGIONS AT AN OILFIELD

(71) Applicant: Schlumberger Technology Corporation, Sugar Land, TX (US)

(72) Inventors: Dmitriy Ivanovich Potapenko, Sugar Land, TX (US); William Batzer, Houston, TX (US); Robert Utter, Sugar Land, TX (US); Donald W. Lee, Houston, TX (US); George Alan Waters, Oklahoma City, OK (US); Douglas Pipchuk, London (GB); Ryan Rodgers, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/332,418

(22) PCT Filed: Sep. 12, 2017

(86) PCT No.: PCT/US2017/051071
§ 371 (c)(1),
(2) Date: Mar. 12, 2019

(87) PCT Pub. No.: WO2018/049367
PCT Pub. Date: Mar. 15, 2018

(65) Prior Publication Data

US 2021/0102452 A1 Apr. 8, 2021

Related U.S. Application Data

(60) Provisional application No. 62/393,416, filed on Sep. 12, 2016.

(51) Int. Cl.
*E21B 34/00* (2006.01)
*E21B 7/06* (2006.01)
(Continued)

(52) U.S. Cl.
CPC ..... *E21B 43/26* (2013.01); *E21B 7/061* (2013.01); *E21B 43/305* (2013.01)

(58) Field of Classification Search
None
See application file for complete search history.

(56) References Cited

U.S. PATENT DOCUMENTS 2,731,414 A 1/1956 Binder, Jr.
2,808,109 A 10/1957 Kirk
(Continued)

FOREIGN PATENT DOCUMENTS

CN 102504292 A 6/2012
CN 105349166 A 2/2016
(Continued)

OTHER PUBLICATIONS

Pinto, I.S.S. et al., "Biodegradable chelating agents for industrial, domestic, and agricultural applications—a review", Environmental Science and Pollution Research, 2014, 21, pp. 11893-11906.
(Continued)

*Primary Examiner* — Matthew Troutman
*Assistant Examiner* — Douglas S Wood
(74) *Attorney, Agent, or Firm* — Jeffrey D. Frantz

(57) ABSTRACT

A technique for providing a fluid conduit between a main bore and a substantially non-producing region of a fracture at a horizontal section of the bore. The technique includes forming a micro-tunnel from a location of the bore adjacent the fracture. The micro-tunnel may be directed at the non-producing region with a angled deflector or in a steerable manner. Additionally, the well may be configured with micro-tunneling at the outset or retrofitted with micro-tunnels as a manner of restoring production.

20 Claims, 5 Drawing Sheets

(51) Int. Cl.
*E21B 43/26* (2006.01)
*E21B 43/30* (2006.01)

(56) References Cited

U.S. PATENT DOCUMENTS 3,282,337 A 11/1966 Pye
3,336,221 A 8/1967 Ralston
3,553,099 A 1/1971 Savage
3,704,750 A 12/1972 Miles
3,878,884 A 4/1975 Raleigh
3,892,274 A 7/1975 Dill
4,007,797 A 2/1977 Jeter
4,032,460 A 6/1977 Zilch et al.
4,036,732 A 7/1977 Irani et al.
4,046,668 A 9/1977 Farcasiu et al.
4,046,669 A 9/1977 Blaine et al.
4,108,760 A 8/1978 Williams et al.
4,139,450 A 2/1979 Hanson et al.
4,347,118 A 8/1982 Funk et al.
4,479,541 A 10/1984 Wang
4,519,463 A 5/1985 Schuh
4,613,631 A 9/1986 Espenscheid et al.
4,640,362 A 2/1987 Schellstede
4,666,683 A 5/1987 Brown et al.
4,848,486 A 7/1989 Bodine
4,928,767 A * 5/1990 Jelsma ..... E21B 23/00 166/117.6
4,977,961 A 12/1990 Avasthi
RE33,660 E 8/1991 Jelsma
5,261,489 A 11/1993 Jennings, Jr. et al.
5,335,726 A 8/1994 Rodrigues
5,358,051 A 10/1994 Rodrigues
5,373,906 A 12/1994 Braddick
5,575,335 A * 11/1996 King ..... C09K 8/62 507/924
5,868,210 A 2/1999 Johnson et al.
5,893,416 A 4/1999 Read
6,581,690 B2 6/2003 Van Drentham-Susman et al.
7,347,260 B2 3/2008 Ferguson et al.
7,419,005 B2 * 9/2008 Al-Muraikhi ..... E21B 43/305 166/380
7,422,059 B2 9/2008 Jelsma
7,431,083 B2 10/2008 Olsen
7,441,595 B2 10/2008 Jelsma
7,686,101 B2 3/2010 Belew et al.
7,788,037 B2 8/2010 Soliman et al.
7,971,658 B2 7/2011 Buckman, Sr.
7,971,659 B2 7/2011 Gatlin et al.
8,167,060 B2 5/2012 Brunet et al.
8,201,643 B2 6/2012 Soby et al.
8,220,547 B2 7/2012 Craig et al.
8,372,786 B2 2/2013 Berkland et al.
8,408,333 B2 4/2013 Pai et al.
8,420,576 B2 4/2013 Eoff et al.
8,424,620 B2 4/2013 Perry, Jr. et al.
8,590,618 B2 11/2013 Jelsma
8,672,034 B2 3/2014 Al-Ajmi et al.
8,770,316 B2 7/2014 Jelsma
9,121,272 B2 9/2015 Potapenko et al.
9,567,809 B2 2/2017 Savage
9,803,134 B2 10/2017 De Wolf et al.
9,966,351 B2 * 5/2018 Toyama ..... H01L 24/14
9,976,351 B2 * 5/2018 Randall ..... E21B 7/18
10,005,955 B2 6/2018 Beuterbaugh et al.
2002/0005286 A1 1/2002 Mazorow et al.
2003/0062167 A1 4/2003 Surjaatmadja et al.
2003/0201103 A1 * 10/2003 Brookey ..... E21B 21/003 166/283
2005/0056418 A1 3/2005 Nguyen
2005/0230107 A1 10/2005 McDaniel et al.
2006/0048946 A1 3/2006 Al-Muraikhi
2006/0070740 A1 4/2006 Surjaatmadja et al.
2006/0102343 A1 5/2006 Skinner et al.
2007/0044957 A1 * 3/2007 Watson ..... E21B 33/03 166/50
2007/0261852 A1 11/2007 Surjaatmadja et al.
2007/0261887 A1 11/2007 Pai et al.
2008/0078548 A1 4/2008 Pauls et al.
2008/0135292 A1 6/2008 Sihler et al.
2008/0139418 A1 6/2008 Cioletti et al.
2009/0017678 A1 1/2009 Meier et al.
2009/0065253 A1 3/2009 Suarez-Rivera et al.
2009/0101414 A1 4/2009 Brunet et al.
2009/0107678 A1 4/2009 Buckman, Sr.
2009/0114385 A1 5/2009 Lumbye
2009/0250211 A1 10/2009 Craig
2009/0288884 A1 11/2009 Jelsma
2010/0126722 A1 5/2010 Cornelissen et al.
2010/0187012 A1 7/2010 Belew et al.
2010/0243266 A1 9/2010 Soby et al.
2010/0282470 A1 * 11/2010 Alberty ..... E21B 33/138 166/308.1
2011/0005762 A1 1/2011 Poole
2011/0017468 A1 1/2011 Birch et al.
2011/0061869 A1 3/2011 Abass et al.
2011/0067871 A1 3/2011 Burdette et al.
2011/0068787 A1 3/2011 Freedman et al.
2011/0147088 A1 6/2011 Brunet et al.
2012/0024530 A1 2/2012 Todd et al.
2012/0067646 A1 3/2012 Savage
2012/0160567 A1 6/2012 Belew et al.
2012/0325555 A1 12/2012 Jette et al.
2013/0000908 A1 1/2013 Walters et al.
2013/0032349 A1 2/2013 Alekseenko et al.
2013/0062125 A1 3/2013 Savage
2013/0213716 A1 8/2013 Perry et al.
2013/0220606 A1 8/2013 Yhuel et al.
2013/0233537 A1 9/2013 McEwen-King et al.
2013/0304444 A1 11/2013 Strobel et al.
2013/0341029 A1 12/2013 Roberts et al.
2014/0096950 A1 4/2014 Pyecroft et al.
2014/0096966 A1 4/2014 Freitag
2014/0102708 A1 4/2014 Purkis et al.
2014/0144623 A1 5/2014 Pyecroft et al.
2014/0340082 A1 11/2014 Yang et al.
2015/0007988 A1 1/2015 Ayasse
2015/0096748 A1 4/2015 West
2015/0107825 A1 4/2015 Miller et al.
2015/0218925 A1 8/2015 Lecampion et al.
2015/0337613 A1 11/2015 Belew et al.
2015/0356403 A1 12/2015 Storm, Jr.
2016/0053597 A1 2/2016 Brown et al.
2016/0115772 A1 4/2016 Graham et al.
2016/0131787 A1 5/2016 Quirein et al.
2016/0153239 A1 * 6/2016 Randall ..... E21B 23/14 166/308.1
2016/0160619 A1 6/2016 Randall
2016/0215581 A1 7/2016 Ingraham et al.
2016/0230526 A1 * 8/2016 Crews ..... E21B 43/26
2016/0281480 A1 9/2016 Pyecroft et al.
2016/0312587 A1 10/2016 Montaron et al.
2017/0030180 A1 * 2/2017 Maurer ..... E21B 33/12
2017/0204713 A1 7/2017 Bell et al.
2018/0023375 A1 1/2018 Potapenko et al.
2018/0112468 A1 4/2018 Savage et al.
2018/0163122 A1 6/2018 Panga et al.
2018/0306017 A1 10/2018 Savage
2018/0328118 A1 11/2018 Morse et al.
2019/0017358 A1 1/2019 Morse et al.
2020/0157901 A1 5/2020 Cardon et al.

FOREIGN PATENT DOCUMENTS

EP 2631422 A2 8/2013
EP 2672409 A2 12/2013
EP 2198119 B1 10/2017
GB 2406863 A 4/2005
WO 9113177 A1 9/1991
WO 9420727 A1 9/1994
WO 0046484 A1 2/2000
WO 03050377 A1 6/2003
WO 2004046494 A2 6/2004
WO 2005090747 A1 9/2005
WO 2009/096805 A1 8/2009

(56) References Cited

FOREIGN PATENT DOCUMENTS

| | | | |
|---|---|---|---|
| WO | 2009157812 | A1 | 12/2009 |
| WO | 2013019390 | A1 | 2/2013 |
| WO | 2015089458 | A1 | 6/2015 |
| WO | 2016/138005 | A1 | 9/2016 |
| WO | 2017074722 | A1 | 5/2017 |
| WO | 2017078989 | A1 | 5/2017 |
| WO | 2018049311 | A1 | 3/2018 |
| WO | 2018049368 | A1 | 3/2018 |
| WO | 2018129136 | A1 | 7/2018 |
| WO | 2019014160 | A1 | 1/2019 |
| WO | 2019014161 | A1 | 1/2019 |
| WO | 2019168885 | A1 | 9/2019 |
| WO | 2019241454 | A1 | 12/2019 |
| WO | 2019241455 | A1 | 12/2019 |
| WO | 2019241456 | A1 | 12/2019 |
| WO | 2019241457 | A1 | 12/2019 |
| WO | 2019241458 | A1 | 12/2019 |

OTHER PUBLICATIONS

International Search Report and Written Opinion of International Patent Application No. PCT/US2017/051071 dated Dec. 22, 2017; 14 pages.

Alekseenko, O. P., Potapenko, D.I., Chery, S.G., Esipov, D.V., Kuranakov, D.S., Lapin, V.N. "3-D Modeling of fracture initiation from perforated non-cemented wellbore", SPE J., vol. 18, No. 3, 589-600, 2013.

Alekseenko O.P. , Potapenko D.I. , Kuranakov D.S. , Lapin V.N. , Cherny S.G. , and Esipov D.V. "3D Modeling of Fracture Initiation from Cemented Perforated Wellbore", presented at 19th European Conference on Fracture, Kazan, Russia, Aug. 26-31, 2012.

Potyondy, "Simulating stress corrosion with a bonded-particlle model for rock", International Journal of Rock Mechanics and Mining Sciences, vol. 44, Issue 5, Jul. 2007, pp. 677-691.

Atkinson et al., "Acoustic Emission During Stress Corrosion Cracking in Rocks", Earthquake Predition: An International Review, vol. 4, pp. 605-616, 1981.

Wikipedia.org, "Wood's metal", edited May 4, 2019, Accessed Jul. 3, 2019; https://en.wikipedia.org/wiki/Wood%27s_metal.

Office Action received in U.S. Appl. No. 16/629,992 dated Apr. 21, 2021, 53 pages.

Office Action received in U.S. Appl. No. 16/629,992 dated Jan. 18, 2022, 11 pages.

Office Action issued in Eurasian Patent Application No. 201991640 dated Nov. 17, 2021, 4 pages with English translation.

Office Action issued in Kuwait patent application No. KW/P/2019/221 dated Oct. 13, 2021, 6 pages.

2nd Office Action issued in Chinese patent application 201880014781.6 dated Oct. 22, 2021, 23 pages with English Translation.

First Exam issued in Saudi Arabian Patent Application 519401990 dated Jul. 7, 2022, 7 pages with English translation.

First Exam Report issued in Australia Patent Application No. 2018205724 dated Dec. 21, 2022, 6 pages.

Exam Report issued in United Arab Emirates Patent Application No. 6000964/2019 dated May 4, 2023, 9 pages.

* cited by examiner

ATTAINING ACCESS TO COMPROMISED FRACTURED PRODUCTION REGIONS AT AN OILFIELD

PRIORITY CLAIM/CROSS REFERENCE TO RELATED APPLICATION(S)

This Patent Document claims priority under 35 U.S.C. § 119 to U.S. Provisional App. Ser. No. 62/393,416, filed on Sep. 12, 2016, entitled "Methods of Reservoir Stimulation with Fracturing and Interconnected Tunnels", which is incorporated herein by reference in its entirety.

BACKGROUND

Exploring, drilling and completing hydrocarbon and other wells are generally complicated, time consuming and ultimately very expensive endeavors. As a result, over the years well architecture has become more sophisticated where appropriate in order to help enhance access to underground hydrocarbon reserves. For example, as opposed to wells of limited depth, it is not uncommon to find hydrocarbon wells exceeding 30,000 feet in depth. Furthermore, as opposed to remaining entirely vertical, today's hydrocarbon wells often include deviated or horizontal sections aimed at targeting particular underground reserves.

While such well depths and horizontal architecture may increase the likelihood of accessing underground hydrocarbons, other challenges are presented in terms of well management and the maximization of hydrocarbon recovery from such wells. For example, as is often the case with vertical wells, stimulation operations may take place to encourage production from lateral or horizontal regions of the well. This may be done in a zone by zone fashion with perforating applications followed by fracturing applications to form fractures deep into targeted regions of a formation.

For example, a perforating gun may be suspended at the end of coiled tubing that is advanced to within the horizontal section of the well. The gun may then be employed for forming perforations through the well casing and into the surrounding formation. Subsequent hydraulic fracturing applications may be undertaken in order to deliver proppant and further encourage hydrocarbon recovery from the formation via the formed fractures.

The above described manner and sequence of stimulating the well would be largely the same for a vertical well as it is for the horizontal well described. However, the results in terms of enhancing production may be quite different. That is, a horizontal well targeting a production region of a particular formation may be more efficient than a vertical well traversing the same region generally, the impact of stimulation is often less dramatic for the horizontal well. More specifically, stimulating with a standard amount of proppant, a two-fold production increase might be expected when stimulating a horizontal well. However, it would not be unexpected for a similar stimulation utilizing the same amount of proppant to result in a five to ten-fold increase in production efficiency when stimulating a vertical well. That is not to say that the horizontal well is necessarily less productive but rather that stimulation operations applied to the horizontal well are often less impactful than desired.

Unlike a vertical well, the horizontal well is likely to traverse a particular formation layer roughly in parallel with the layer as opposed to traversing several different layers of a formation as a vertical well would. This roughly 90° difference in orientation means that the fractures which are formed from the horizontal well are often the features that traverse different formation layers above and below the horizontal section. Once more, unlike a vertical well section, the fractures are not supported with the robustness of casing or other structural support. Rather, the fractures are more akin to open-hole channels supported internally by proppant and perhaps some fibers or other constituents.

The lack of structural support in fractures traversing layered or strata of a formation lends them susceptible to issues that may largely close off portions of the fractures to production. For example, as the fracture is formed under pressure it may laminate through various strata. This is a process whereby the fracture extends vertically from the horizontal well for a distance but then shifts laterally or horizontally in one direction or another when reaching a new formation layer. Thus, a fracture that is open when being formed under pressure is susceptible to later being closed off at this lateral "pinch point" when time for production.

In another example, strata in the form of ash or other geologic material may tend to combine with the proppant mixture following stimulation to largely seal off the fracture. That is, where a vertically extended fracture traverses an ash bed formation layer, the latter introduction of proppant during the stimulation operations may ultimately close off the fracture at the ash bed location.

Where the architectural layout of an oilfield calls for a horizontal well, such wells are generally employed to enhance production. However, due to unique challenges faced by fractures of such wells, production efficiency is often not enhanced by stimulation operations to the extent desired. Indeed, it may often be the case that well production is prematurely terminated and the well killed even though fractures of the horizontal well remain in communication with a formation's production fluids.

SUMMARY

A method of providing fluid communication between a main bore of a horizontal well and a substantially non-producing region of a formation encompassed by a fracture from the main bore is disclosed. The method includes forming a micro-tunnel from a tunnel location that is adjacent a fracture location at the main bore to intersect the non-producing region.

DETAILED DESCRIPTION

Embodiments are described with reference to horizontal well fracturing and stimulation applications. In particular, downhole fracturing where repeated frac zones or fractures emerging vertically from a horizontal main bore is depicted. This may be through repeated isolating and stimulation applications to form the fractures. Regardless of the particular techniques employed to form the fractures or the number of fractures themselves, the embodiments herein are directed at an architectural layout for a well that introduces micro-tunnels to provide access to compromised or substantially non-producing regions of a fracture. This may include circumstances in which the fracture failed to fluidly link with the main bore following stimulation and/or circumstances where such fluid link is being restored through a micro-tunnel, for example, where the non-producing region became fluidly inaccessible some period after stimulation.

Additionally, as used herein, the term "micro-tunnel" is not meant to place a particular size restriction on the embodiments of tunnels described herein. Rather, the term is meant to infer that these "micro" tunnels would generally be smaller in initial diameter than the main bore of the horizontal well from which these tunnels would be expected to emerge. Of course, circumstances may arise where these micro-tunnels are of variable diameter as they are formed through an open formation toward a substantially non-producing region as detailed herein. Regardless, so long as fluid access between the non-producing region and the horizontal main bore is formed or restored, appreciable benefit may be realized.

Figure 1:
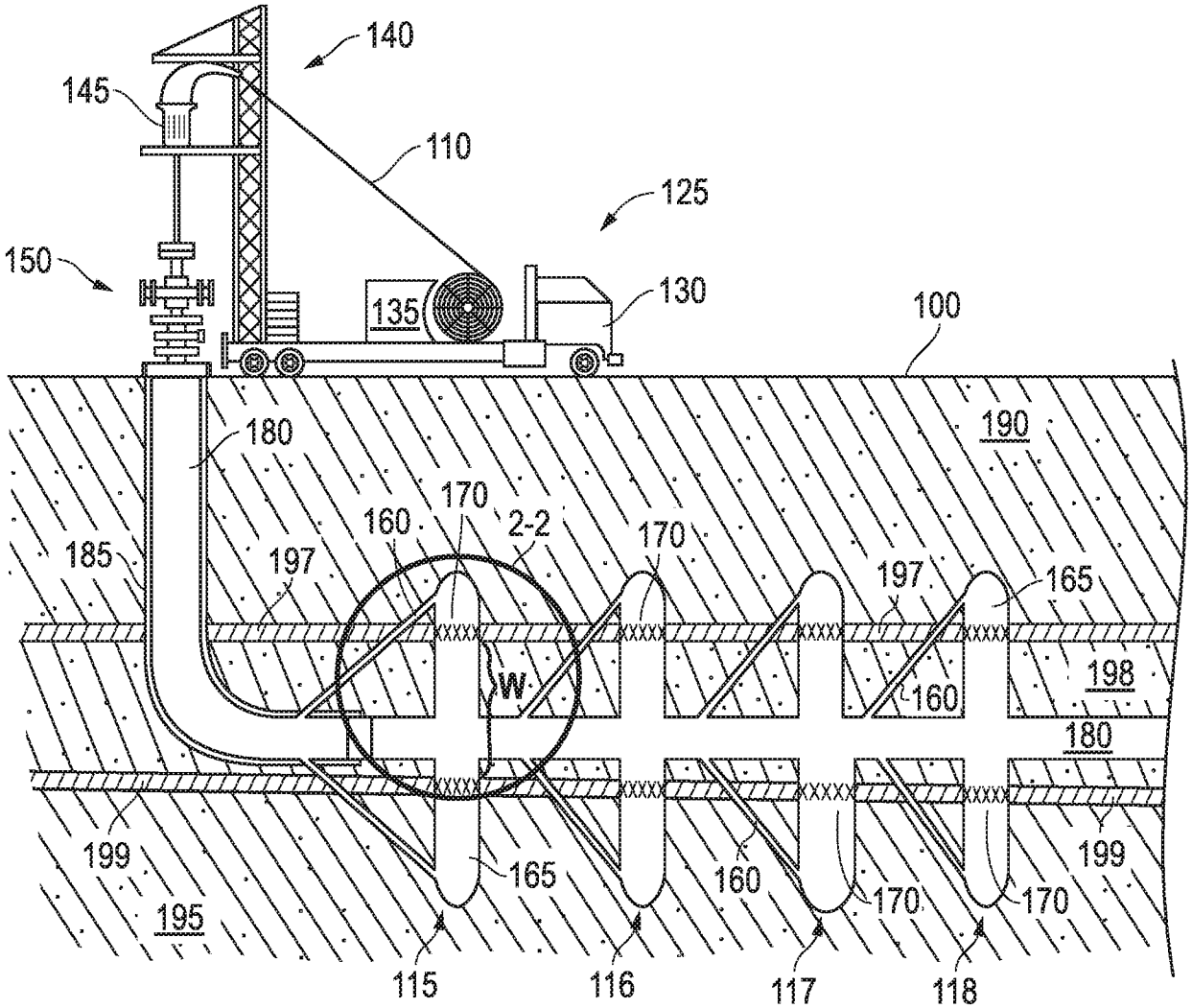
FIG. 1 is an overview depiction of an oilfield with embodiments of micro-tunnels connecting a main bore with a substantially non-producing region of fractures.

Referring now to FIG. 1, an overview depiction of an oilfield 100 is shown with embodiments of micro-tunnels 160 connecting a main bore 180 with a substantially non-producing region 165 of fractures 115, 116, 117, 118. As shown, the main bore 180 transitions from substantially vertical to deviated or substantially horizontal as the fractures 115, 116, 117, 118 emerge therefrom. Thus, the fractures 115, 116, 117, 118 are substantially vertical themselves. This means that each given fracture 115, 116, 117, 118 may traverse a variety of formation layers 190, 195, 197, 198, 199. This is in contrast to circumstances where fractures might extend horizontally from a vertical section of the main bore 180 and more likely traverse only one or two formation layers.

With the possibility of transecting so many formation layers 190, 195, 197, 198, 199, the opportunity for a substantially vertical fracture 115, 116, 117, 118 to be compromised by a given formation layer 190, 195, 197, 198, 199 may be increased. Thus, the micro-tunnels 160 depicted herein may be utilized to provide fluid communication between the main bore 180 and an otherwise substantially non-producing region 165 of the fractures 115, 116, 117, 118. For example, in the embodiment shown, the fractures 115, 116, 117, 118 may transect certain formation layers in the form of ash beds 197, 199 which, as detailed below, may tend to seal off production following stimulation. This is reflected by fracture seals 170 depicted in the formation which close off certain regions 165 of the fractures 115, 116, 117, 118 from the rest of the fracture 115, 116, 117, 118 and the main bore 180. However, the micro-tunnels 160 may be used to create or restore access to such regions 165. Indeed, the term used herein for these regions 165 is "substantially non-producing" as noted above. However, this is only meant to infer the character of these regions in absence of the illustrated micro-tunnels 160. More specifically, upon intersecting these regions 165 with micro-tunnels 160 as illustrated, they may take on a substantially producing character.

Continuing with reference to FIG. 1, the oilfield 100 depicts architecture that in many respects is not atypical. A main well bore 180 has been formed with a vertical section defined by casing 185. The well bore 180 transitions into a horizontal section that may be open-hole or perhaps fitted with a slotted liner or other defining structure that is adept at supporting hydrocarbon production from the surrounding formation (e.g. 190, 195, 197, 198, 199). Further along these lines, the depicted fractures 115, 116, 117, 118 are shown which have been formed following a sequential fracturing application. For example, a series of zonal isolation, perforating and stimulating applications may be employed to form the fractures 115, 116, 117, 118 as shown. Ultimately, stimulation leaves the fractures 115, 116, 117, 118 largely filled with proppant for integral support. However, in certain circumstances, this may result in interaction with certain types of formation materials such as ash which may result in the described seals 170.

In absence of the micro-tunnels 160, a given fracture 115 may be left with a production window (W) as depicted due to the seals 170. Thus, micro-tunnels 160 may be effective in restoring effective access to the entirety of the fracture 115. Of course, in other embodiments, alternative features may work to cut off access to portions of a fracture 115. For example, where the fracture traverses laminated formation layers that tend to guide the fracture 115 to shift laterally in one direction or another as it traverses different layers, pinch points may form. These points may act similar to seals in presenting a challenge to production toward the main bore 180 from regions of the fracture 115 that are beyond the pinch points. Thus, in absence of micro-tunnels 160, these regions 165 may again be termed substantially "non-producing".

Continuing with added reference to FIG. 1, the oilfield 100 is shown accommodating a variety of surface equipment 125. Specifically, following stimulation operations as noted above, equipment 125 may be brought to the site which is directed specifically at creating the described micro-tunnels 160. For example, in the embodiment shown, coiled tubing 110 is brought to the wellsite to aid in forming the tunnels 160 as detailed below. This may immediately follow large scale stimulation operations which provided the depicted fractures 115, 116, 117, 118. Alternatively, in circumstances where seals 170 or other obstructions are not certain to emerge for an extended period of time, if at all, the tunnel forming equipment 125 may be brought to the wellsite long after production operations have commenced. For example, the equipment 125 may be used to restore well production after production through fracture windows (W) has been exhausted. That is, rather than cease operations, micro-tunnel architecture may be added.

In the embodiment shown, the equipment 125 includes a mobile coiled tubing truck 130 with a reel to deploy the coiled tubing 110 and a control unit 135 to guide the operations. A mobile rig 140 supports a standard gooseneck injector 145 for driving the coiled tubing 110 and a micro-tunneling tool downhole beyond pressure control equipment 150 (e.g. see the jetting tool 475 of FIG. 4B). Of course, a variety of other types of tools may be used to form the tunnels 160 which may be delivered by means other than coiled tubing 110. For example, water jetting as indicated, drilling with drill pipe, microcoil or utilizing a borehole assembly (BHA) with a dedicated downhole motor associated with the tunneling tool or a variety of other suitable tunneling techniques may be utilized. In one embodiment, the BHA may be a combinatory tool equipped with both a window cutting tool for creating a hole in casing or liner if need be in advance of using a tunneling tool for creating the micro-tunnel 160 through the formation 198.

Figure 2:
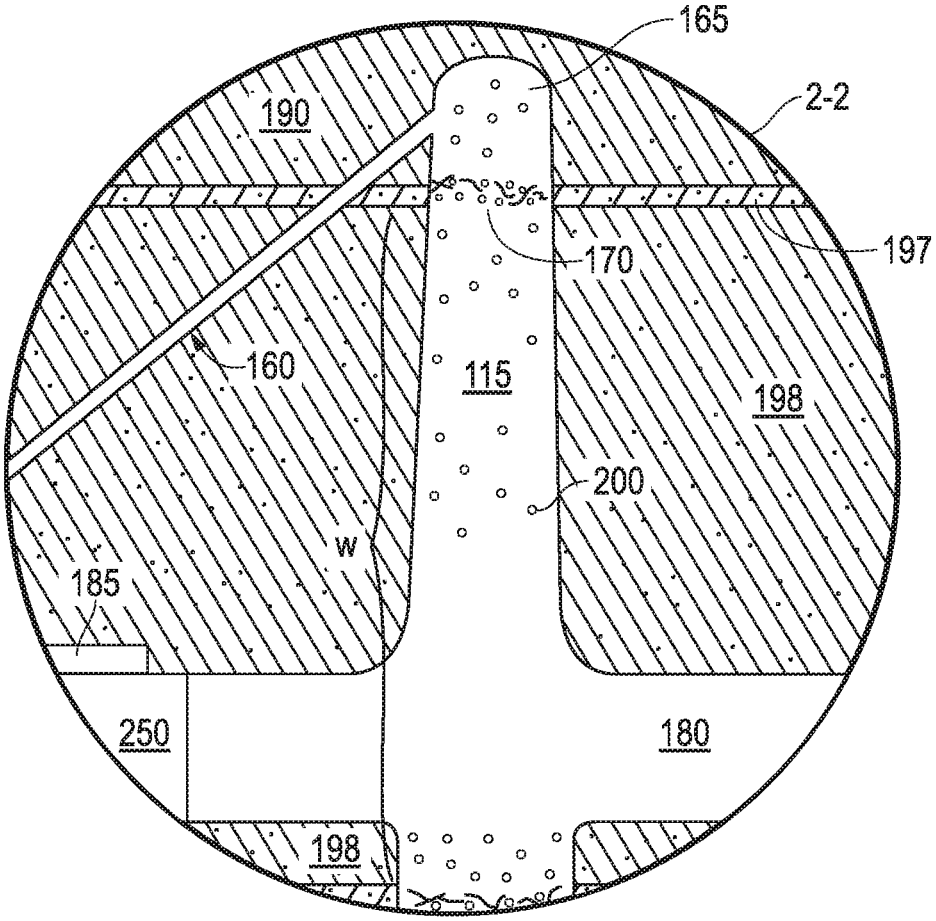
FIG. 2 is an enlarged view of an embodiment of a micro-tunnel of FIG. 1 taken from 2-2 of FIG. 1.

Referring now to FIG. 2, an enlarged view of a micro-tunnel 160 and surrounding features taken from 2-2 of FIG. 1 is shown. In this enlarged view, the casing 185 is shown terminating at a production packer 250 which may support a tubing hanger, liner or other lower completion hardware through the horizontal portion of the main bore 180. That is, this portion of the main bore 180 is specifically targeted for the production of hydrocarbons. However, as noted above, a seal 170 which has formed at the ash layer 197 is apparent. This is not an uncommon occurrence when conventional proppant 200 such as sand mixes with these types of formation particles. Thus, as noted above, in absence of such tunnels 160, production from the fracture 115 might be largely limited to the depicted production window (W), with sealed off non-producing regions 165 beyond any ash layers 197 (see also FIG. 1).

In order to provide or restore access to such regions 165, micro-tunnels 160 may be provided. Such micro-tunnels 160 may vary in length depending on practicality and need. For example, the tunnels 160 may range from 2 meters to 200 meters in length. These tunnels 160 may be formed with tools as indicated above which are guided by prior obtained formation data. That is, just as logging information regarding the formation may play a role in the layout of the main bore 180 and other features, such information may also play a role in determining where to have a tunnel 160 emerge from the main bore 180, the angle to employ, etc. For the particular micro-tunnel 160 shown in FIG. 2, the tunnel 160 emerges from the main bore 160 at a casing location immediately uphole of, and adjacent, the fracture 115. Therefore, forming the tunnel 160 may involve use of a drilling or other suitable tool for forming a casing window.

Figure 3:
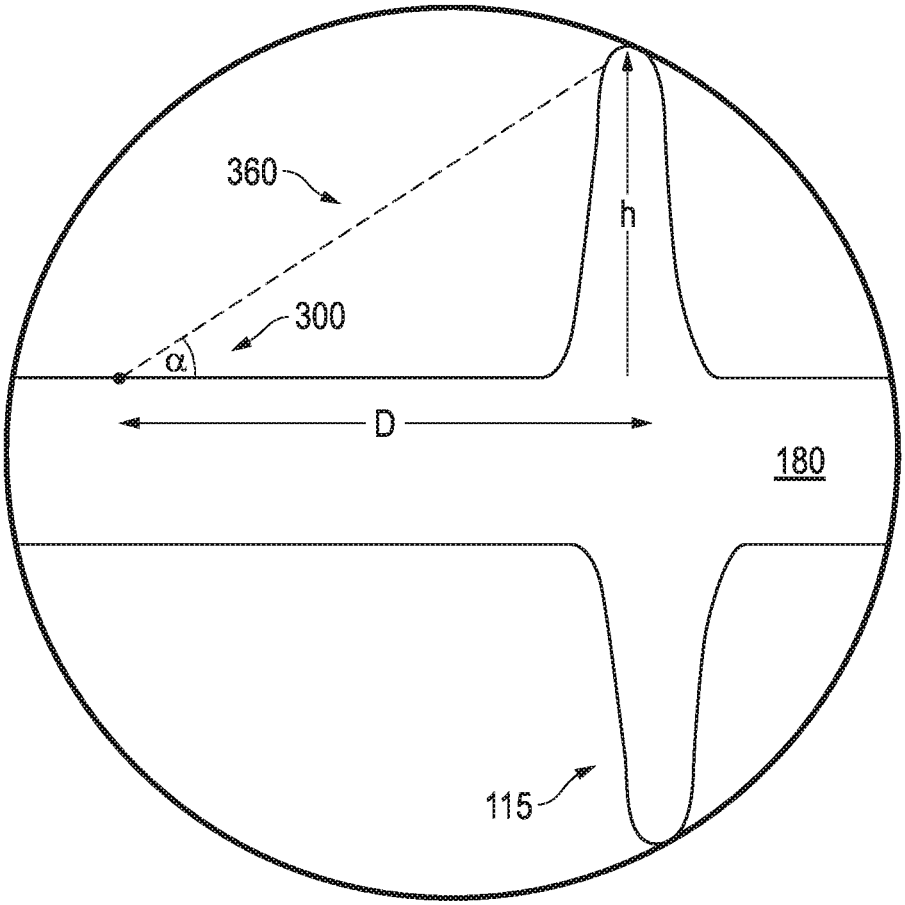
FIG. 3 is a schematic representation of the horizontal main bore and a fracture of FIG. 1 revealing angular calculations for the micro-tunnel of FIG. 2.

Referring now to FIG. 3, with added reference to FIG. 2, a schematic representation of the horizontal main bore 180 and this same fracture 115 of FIG. 1 is shown revealing angular considerations for the micro-tunnel 160 of FIG. 2. For example, the path 360 for a straight micro-tunnel 160 emerging from the main bore 180 would track along an angle of less than about 90°. The closer the angle to 90°, the longer the tunnel 160 would need to be in order to reach the fracture 115. In the embodiment shown, the targeted region 165 for intersecting the fracture 115 is near one end thereof as depicted. Of course, this may not always be the case. Circumstances may arise where non-productive regions 165 are at other locations of the fracture 115 or at multiple locations, perhaps calling for multiple tunnels 160 to emerge from the same side of the main bore 180.

Continuing with reference to FIGS. 2 and 3, in the embodiment shown, the angle 300 is about 45° with the location emerging from the main bore 180 at a distance (D) of about 100 meters from the center of the fracture 115. Once more, the height (h) of the fracture is about 75 meters. Thus, where the path 360 is to intersect the fracture 115 at about its height, this means that the micro-tunnel 160 would be about 125 meters in length. This is determined from a simple right triangle equation where the hypotenuse (the path 360) is equal to the square root of $(D^2+h^2)$. Of course, this is only an illustrative example, the length of the path 360, where to have the tunnel 160 emerge from the bore, the specific angle 300 to be utilized may be determined together in light of logging information available, the type of tool utilized in forming the tunnel 160 and a host of other factors. For example, the angle 300 may be between about 5° and 90° where a jetting tool is employed and between about 18° and 90° where a drilling tool is utilized.

Figure 4A:
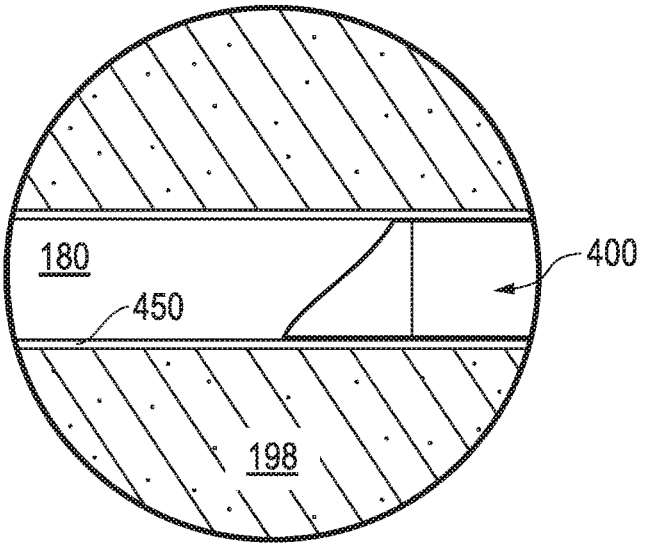
FIG. 4A is an enlarged depiction of an embodiment of an angled deflector positioned in the horizontal main bore.

Referring now to FIG. 4A, an enlarged depiction of an embodiment of an angled deflector 400 is shown positioned in the horizontal main bore 180. In this embodiment, a liner 450 is also shown defining this portion of the main bore 180 as is often found in such horizontal lower completions. Continuing with the example of FIG. 3, the deflector 400 may be a 45° deflector deployed to the depicted location with the coiled tubing 110 of FIG. 1, drillstring or other appropriate conveyance.

Figure 4B:
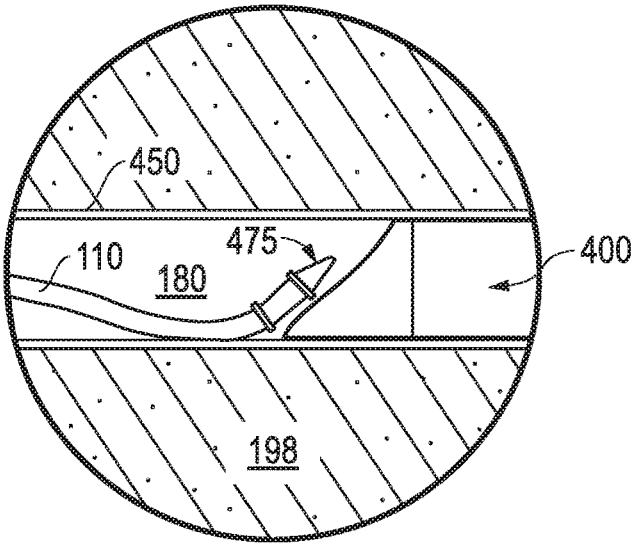
FIG. 4B is an enlarged depiction of the angled deflector of FIG. 4A interfacing an embodiment of a micro-tunneling device.

Referring now to FIG. 4B, an enlarged depiction of the angled deflector 400 of FIG. 4A is shown interfacing an embodiment of a micro-tunneling device 475. In the embodiment shown, the device 475 is a water jetting tool capable of penetrating both the liner 450 and the adjacent formation 198. Further, it is deployed to the site of the deflector 400 via the coiled tubing 110 and associated equipment depicted in FIG. 1. Of course in other embodiments, alternative forms of deployments and/or devices may be utilized. For example, laser cutting, perforating, electrical decomposition and drilling may also be utilized. Laser cutting in particular may be desirable where the micro-tunnel 160 is to be of an extended length given the propensity to maintain straightness due to lack of physical contact with the formation 198 as the tunnel 160 is being formed.

Figure 4C:
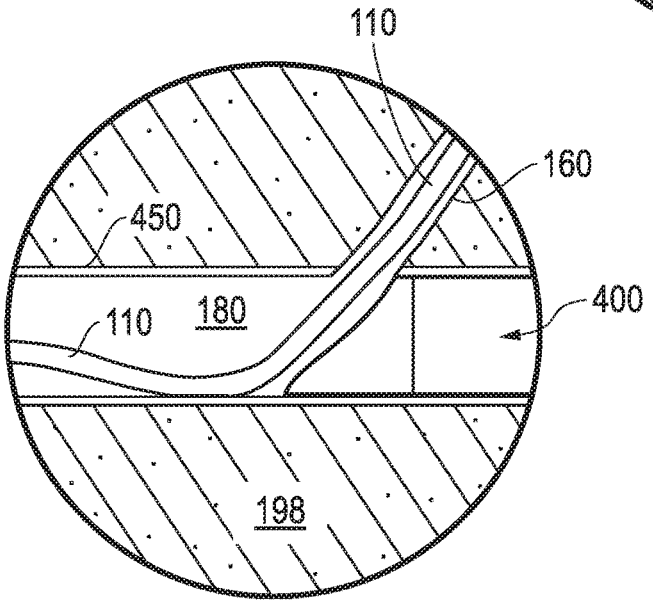
FIG. 4C is an enlarged depiction of the micro-tunneling device of FIG. 4B forming an embodiment of a micro-tunnel from the main bore.

Referring now to FIG. 4C, an enlarged depiction of the micro-tunneling device 475 of FIG. 4B is shown forming an embodiment of a micro-tunnel 160 as the coiled tubing 110 exits the main bore 180 as directed by the deflector 400. However, in other embodiments other techniques for forming the tunnel 160 may be utilized. Additionally, once the micro-tunnel 160 is formed, the deflector 400 may be repositioned and/or reoriented to form a subsequent micro-tunnel 160 (e.g. as illustrated in FIG. 1).

Figure 5:
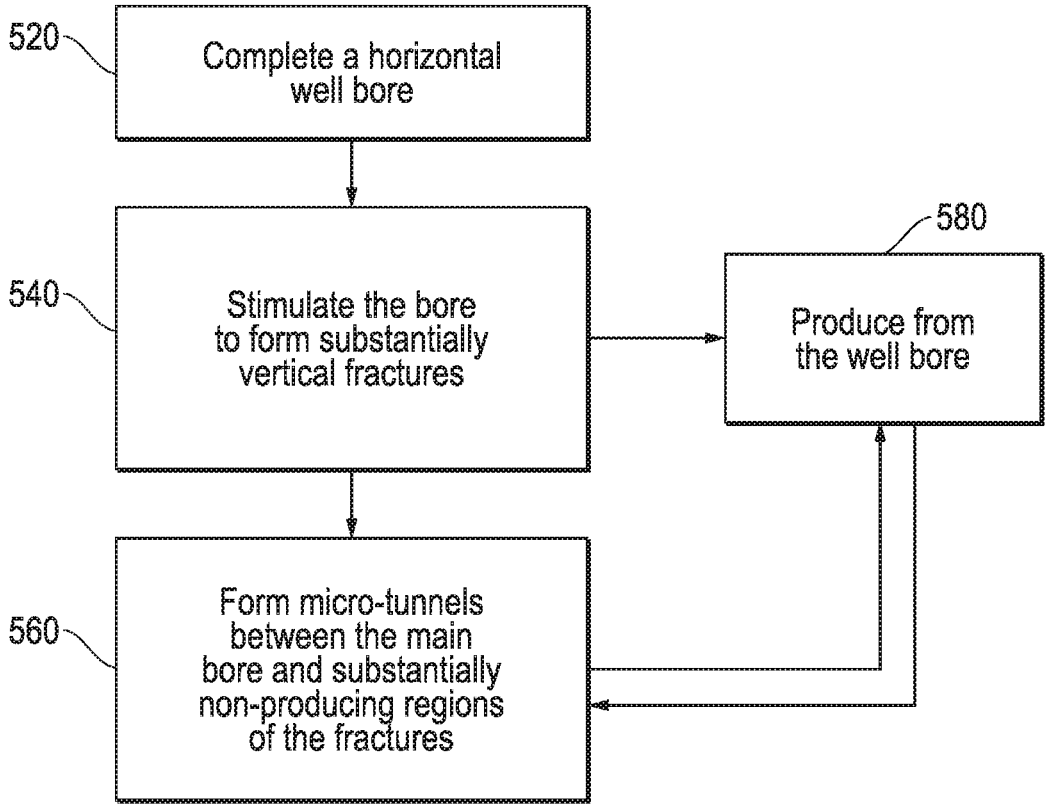
FIG. 5 is a flow-chart summarizing an embodiment of providing access to compromised fractured production regions.

Referring now to FIG. 5, a flow-chart summarizing an embodiment of providing access to compromised fractured production regions is illustrated. Namely, a horizontal well is completed as indicated at 520 which allows for stimulation operations to ultimately form substantially vertical fractures as noted at 540. The well may then be produced at the outset (see 580). However, even before production begins, micro-tunnels may be formed between the main bore and predicted non-producing regions of various fractures as noted at 560. Of course, in other embodiments, these micro-tunnels may be formed as a restorative measure following production that has fallen off or ceased.

Embodiments described hereinabove include techniques that allow for stimulation efforts directed at horizontal wells to be of enhanced efficiency. That is, while stimulated horizontal wells are often compromised in terms of effective production access to all fracture regions, the embodiments detailed hereinabove address this issue. Thus, the impact of stimulation operations on overall production efforts may be maximized.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments depicted herein reveal the use of fairly straight micro-tunnels guided by a deflector. However, micro-tunnels may take on other architecture. Such alternatives may include utilizing a whipstock or other steerable drilling system that allows for a tunneling tool to emerge from the wellbore at one angle, e.g. perpendicular and then steered toward a non-producing region. Furthermore, the foregoing description should not be read as pertaining only to the precise structures described and shown in the accompanying drawings, but rather should be read as consistent with and as support for the following claims, which are to have their fullest and fairest scope.

We claim:

1. A method of providing fluid communication between a main bore of a horizontal well and a plurality of substantially non-producing regions of a formation encompassed by a fracture from the main bore, the method comprising:

stimulating the formation through the main bore of the horizontal and forming the fracture in the formation;

forming a plurality of micro-tunnels from the main bore to the plurality of substantially non-producing regions of the fracture, wherein each substantially non-producing region of the plurality of substantially non-producing regions is separated from other substantially non-producing regions of the plurality of substantially non-producing regions and the main bore by a plurality of seal layers, the plurality of micro-tunnels is disposed on a same side of the fracture, and each micro-tunnel of the plurality of micro-tunnels is formed by:

determining, from prior obtained formation data and after stimulating the formation, a tunnel location, an angle, and a length of each micro-tunnel to reach from the tunnel location to intersect one of the plurality of substantially non-producing regions of the formation based on a height of the fracture and a distance from the tunnel location to the fracture, wherein the height extends from the main bore to a position in the fracture within the respective one of the plurality of substantially non-producing regions beyond a seal layer of the plurality of seal layers in the formation, wherein the seal layer of the plurality of seal layers is offset away from the main bore and at least partially obstructs fluid flow from the respective one of the plurality of substantially non-producing regions to the main bore;

selecting a micro-tunneling tool based on the angle and the length of each micro-tunnel of the plurality of micro-tunnels;

deploying the micro-tunneling tool within the main bore of the horizontal well to the tunnel location for each micro-tunnel of the plurality of micro-tunnels; and forming the micro-tunnel from the tunnel location of the main bore to the fracture at the respective one of the plurality of substantially non-producing regions for each micro-tunnel of the plurality of micro-tunnels.

2. The method of claim 1, wherein deploying the micro-tunneling tool to the tunnel location comprises deploying with one of coiled tubing, micro-coil and drill string.

3. The method of claim 2, wherein selecting the micro-tunneling tool comprises selecting from a group consisting of a jetting tool, a perforating tool, a drill, a laser cutting tool, and electrical decomposition tool and a combinatory tool.

4. The method of claim 3, further comprising cutting structure defining the main bore with a window cutting device of the combinatory tool in advance of the forming of the micro-tunnel.

5. The method of claim 1, wherein the plurality of micro-tunnels extend from a same side of the main bore.

6. The method of claim 1, further comprising forming an additional plurality of micro-tunnels from the main bore to an additional plurality of substantially non-producing regions of an additional fracture along the main bore, wherein each substantially non-producing region of the additional plurality of substantially non-producing regions is separated from other substantially non-producing regions of the additional plurality of substantially non-producing regions and the main bore by an additional plurality of seal layers, the additional plurality of micro-tunnels is disposed on a same side of the additional fracture, and each micro-tunnel of the additional plurality of micro-tunnels is formed by the determining, the selecting, the deploying, and the forming.

7. The method of claim 1, wherein the prior obtained formation data comprises logging data, wherein the tunnel location, the angle, and the length of each micro-tunnel of the plurality of micro-tunnels is independently determined from the logging data and based on the height and the distance.

8. The method of claim 1, wherein the plurality of micro-tunnels extends from opposite first and second sides of the main bore.

9. The method of claim 1, wherein the plurality of micro-tunnels extends upwardly from a top side and downwardly from a bottom side of the main bore.

10. The method of claim 1, wherein determining, from the prior obtained formation data, comprises determining the tunnel location, the angle, and the length of each micro-tunnel to intersect one of the plurality of substantially non-producing regions independently from, and variably relative to, one another for the plurality of micro-tunnels.

11. A method of producing fluid from a well at an oilfield, the method comprising:

stimulating a main bore of a horizontal well;

producing well fluids from a producing region of a fracture serviced by the stimulating of the main bore;

determining, subsequent to stimulating and producing well fluids from the producing region, a plurality of substantially non-producing regions of the fracture and at least one tunnel location in the main bore utilizing formation logging information;

forming a plurality of micro-tunnels from the main bore to the plurality of substantially non-producing regions of the fracture, wherein each substantially non-producing region of the plurality of substantially non-producing regions is separated from other substantially non-producing regions of the plurality of substantially non-producing regions and the main bore by a plurality of seal layers, the plurality of micro-tunnels is disposed on a same side of the fracture, and each micro-tunnel of the plurality of micro-tunnels is formed by:

determining an angle and a length of each micro-tunnel to reach from the at least one tunnel location to intersect one of the plurality of substantially non-producing regions based on a height of the fracture and a distance from the at least one tunnel location to the fracture, wherein the height extends from the main bore to a position in the fracture within the respective one of the plurality of substantially non-producing regions beyond a seal layer of the plurality of seal layers in the formation, wherein the seal layer of the plurality of seal layers is offset away from the main bore and at least partially obstructs fluid flow from the respective one of the plurality of substantially non-producing regions to the main bore; and forming the micro-tunnel, with a micro-tunneling tool, from the at least one tunnel location of the main bore adjacent the fracture to the respective one of the plurality of substantially non-producing regions of the fracture; and producing well fluids from the plurality of substantially non-producing regions via the plurality of micro-tunnels.

12. The method of claim 11, wherein the producing region is separated from each one of the substantially non-producing regions by one of the plurality of seal layers comprising one of a formation seal within the fracture and a pinch point of laminating formation layers.

13. The method of claim 11, wherein the at least one tunnel location and the plurality of micro-tunnels are uphole of the fracture.

14. The method of claim 11, wherein the plurality of micro-tunnels extends from a same side of the main bore.

15. The method of claim 11, wherein the plurality of micro-tunnels extends upwardly from a top side and downwardly from a bottom side of the main bore.

16. The method of claim 11, further comprising:

driving a steerable mechanism of the micro-tunneling tool out of the main bore from the at least one tunnel location in a substantially perpendicular manner relative the main bore; and steering the steerable mechanism of the micro-tunneling tool toward one of the plurality of substantially non-producing regions.

17. The method of claim 11, wherein the determination of the angle and the length of each micro-tunnel to reach from the at least one tunnel location to intersect one of the plurality of substantially non-producing regions is performed independently and variably for each of the plurality of micro-tunnels.

18. A system, comprising:

an architectural layout for a well at an oilfield, the layout comprising:

a substantially horizontal section of a main bore;

at least one substantially vertical fracture in communication with the horizontal section of the main bore formed from a stimulation treatment of the well;

a plurality of substantially non-producing regions of the fracture, wherein each substantially non-producing region of the plurality of substantially non-producing regions is separated from other substantially non-producing regions of the plurality of substantially non-producing regions and the main bore by a plurality of seal layers; and a plurality of micro-tunnels running from one or more tunnel locations adjacent the fracture to the plurality of substantially non-producing regions to provide fluid communication with the main bore, wherein the plurality of micro-tunnels is disposed on a same side of the fracture; and a control unit configured to guide operations of a micro-tunneling tool based on the architectural layout to form each micro-tunnel of the plurality of micro-tunnels, wherein the plurality of micro-tunnels and the one or more tunnel locations are determined utilizing at least one of formation logging information and prior obtained formation data subsequent to the stimulation treatment of the well, wherein each micro-tunnel of the plurality of micro-tunnels is formed utilizing the micro-tunneling tool selected for the respective micro-tunnel based on a determined angle and length of the respective micro-tunnel based on the tunnel location, a height of the fracture, and a distance from the tunnel location to the fracture for the respective micro-tunnel of the plurality of micro-tunnels, wherein the height extends from the main bore to a position in the fracture within one of the plurality of substantially non-producing regions beyond a seal layer of the plurality of seal layers in the formation, wherein the seal layer of the plurality of seal layers is offset away from the main bore and at least partially obstructs fluid flow from the one of the plurality of substantially non-producing regions to the main bore.

19. The system of claim 18, wherein the plurality of micro-tunnels extends from a same side of the main bore.

20. The system of claim 18, comprising the well having the architectural layout, wherein the well comprises a plurality of substantially vertical fractures including the at least one substantially vertical fracture, and the plurality of micro-tunnels includes multiple micro-tunnels for each fracture of the plurality of substantially vertical fractures.

* * * * *